United States Patent [19]

Gilles

[11] 3,949,809

[45] Apr. 13, 1976

[54] AIR PROCESSING APPARATUS

[75] Inventor: Theodore C. Gilles, Marshalltown, Iowa

[73] Assignee: Lennox Industries, Inc., Marshalltown, Iowa

[22] Filed: Jan. 22, 1975

[21] Appl. No.: 543,187

[52] U.S. Cl. ..... 165/22; 165/48; 165/50; 98/40 DL

[51] Int. Cl.[2] ..... F24F 7/00

[58] Field of Search..... 98/40 DL; 165/22, 35, 53, 165/96, 100, 103, 122, 124, 126, 48, 50

[56] References Cited

UNITED STATES PATENTS

| | | | |
|---|---|---|---|
| 3,010,378 | 11/1961 | Geocaris | 98/40 DL |
| 3,090,434 | 5/1963 | Benson, Jr. et al. | 98/40 DL |
| 3,320,404 | 5/1967 | Roux | 98/40 DL |
| 3,354,946 | 11/1967 | Dean, Jr. | 98/40 DL |
| 3,420,439 | 1/1969 | Meckler | 98/40 DL |
| 3,841,393 | 10/1974 | Gilles | 165/22 |

*Primary Examiner*—Albert W. Davis, Jr.
*Assistant Examiner*—James D. Liles
*Attorney, Agent, or Firm*—Allegretti, Newitt, Witcoff & McAndrews

[57] ABSTRACT

The present invention pertains to an air processing system for an enclosed area having a plenum. The system includes an air processing means in communication with the plenum and responsive to a temperature sensing means, air-passing light fixtures for lighting the enclosed area, return air means through which the air processing means receives return air via two separate paths, one being in heat exchange relationship with the light fixtures, damper means for controlling the passage of air through the return air means, power exhaust means and ventilation means for exhausting air from the plenum and enclosure to achieve volume balance. The damper means is constructed and arranged so as to maximize the use of heat from the light fixtures whenever heating is required in the enclosed area and to discharge heat from the light fixtures to the atmosphere whenever cooling is required to reduce the cooling requirement.

16 Claims, 7 Drawing Figures

AIR PROCESSING APPARATUS

BACKGROUND OF THE INVENTION

This invention relates generally to an air processing system, and more particularly, to a novel return air system for use with a heating, cooling and ventilating unit for processing the air in an enclosed area.

Satisfactory processing of the air in an enclosed area requires that the air temperature be kept within a relatively small temperature range. Air processing requirements will, of course, vary with the thermal load within the enclosed area.

Although achieving control of the air temperature within an enclosed area, presently know air processing systems are inefficient in certain respects. For example, in some of the presently known systems, heat produced by lighting fixtures is virtually ignored. In the heating mode, a majority of the "heat of light" remains substantially localized about the lighting fixture, and it is not utilized in the "lived in" regions of the enclosed area. Thus, primary energy or mechanical heating is required, despite the fact that a substantial quantity of "free heat" is readily available. This additional primary energy heating significantly increases the operating cost of the presently known air processing systems.

In the cooling mode, the "heat of light" is again ignored. No attempt is made to lessen its adverse effect on room temperature. Additional mechanical cooling is, therefore, required to overcome the "heat of light," which results in relatively high energy use and operating costs.

Additionally, outside air, in certain situations, provides an economical means for cooling an enclosed area. Many of the presently known air processing systems, however, are not properly equipped to use the outside air and instead mechanical cooling is utilized, with an attendant increase in operating costs.

Even in those systems equipped with "outside air cooling means," the inefficiencies, discussed above, limit this operation to periods of time when the outside air temperature is considerably below the desired room temperature. Generally speaking, the presently known systems can be operated in this mode only when the outside air temperature is less than about 56° F.

SUMMARY OF THE INVENTION

An object of the present invention is to provide a more efficient, less expensive air processing system, as compared with presently known air processing systems.

A further object of the present invention is to provide an improved air processing system wherein room and outside air conditions are used, whenever possible, to effect the processing of the room air, thereby reducing the operating costs of the air processing system.

Another object of the present invention is to provide an improved air processing system wherein the effect of adverse room air conditions is lessened, or alleviated, thereby reducing the amount of necessary mechanical air processing and the cost of such processing.

It is another object of the present invention to provide an improved air processing system wherein room air conditions, e.g., the heat from light, and outside air conditions are utilized and controlled whereby the capacity of the air processing unit, and thus, the overall cost of the air processing system is reduced.

These and other objects which will become apparent from the following detailed description are accomplished by an air processing system including air processing means, return air means and damper means for controlling the flow of air to the air processing means. This return air system permits (1) utilization of conditions existing inside and outside the enclosed area to "pre-process" the room air and (2) alleviation of the effect of such conditions when undesirable.

BRIEF DESCRIPTION OF THE DRAWINGS

A preferred embodiment of the present invention will be described in detail with reference to the drawing wherein.

DETAILED DESCRIPTION OF A PREFERRED EMBODIMENT

Figure 1:
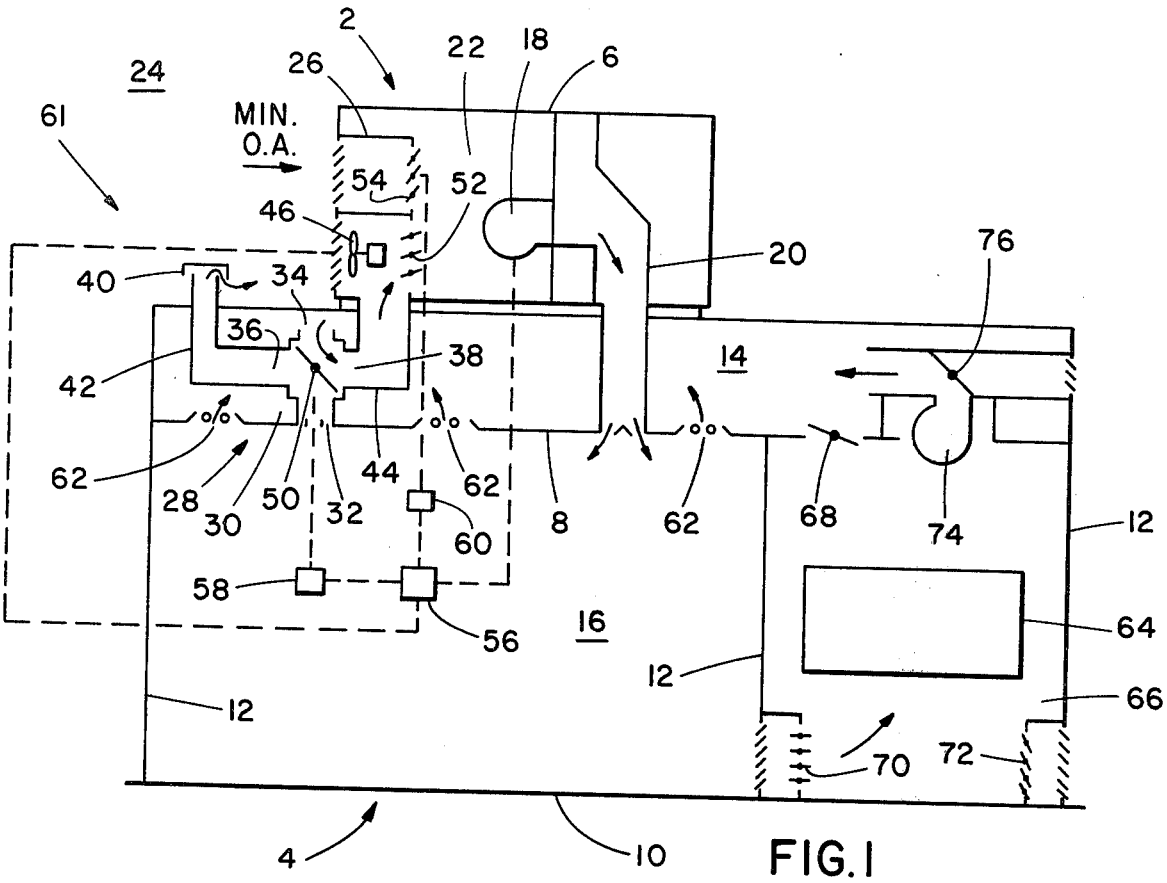
FIG. 1 shows a preferred embodiment of the present invention, operating in the heating mode, in combination with a refrigeration system.
Figure 2:
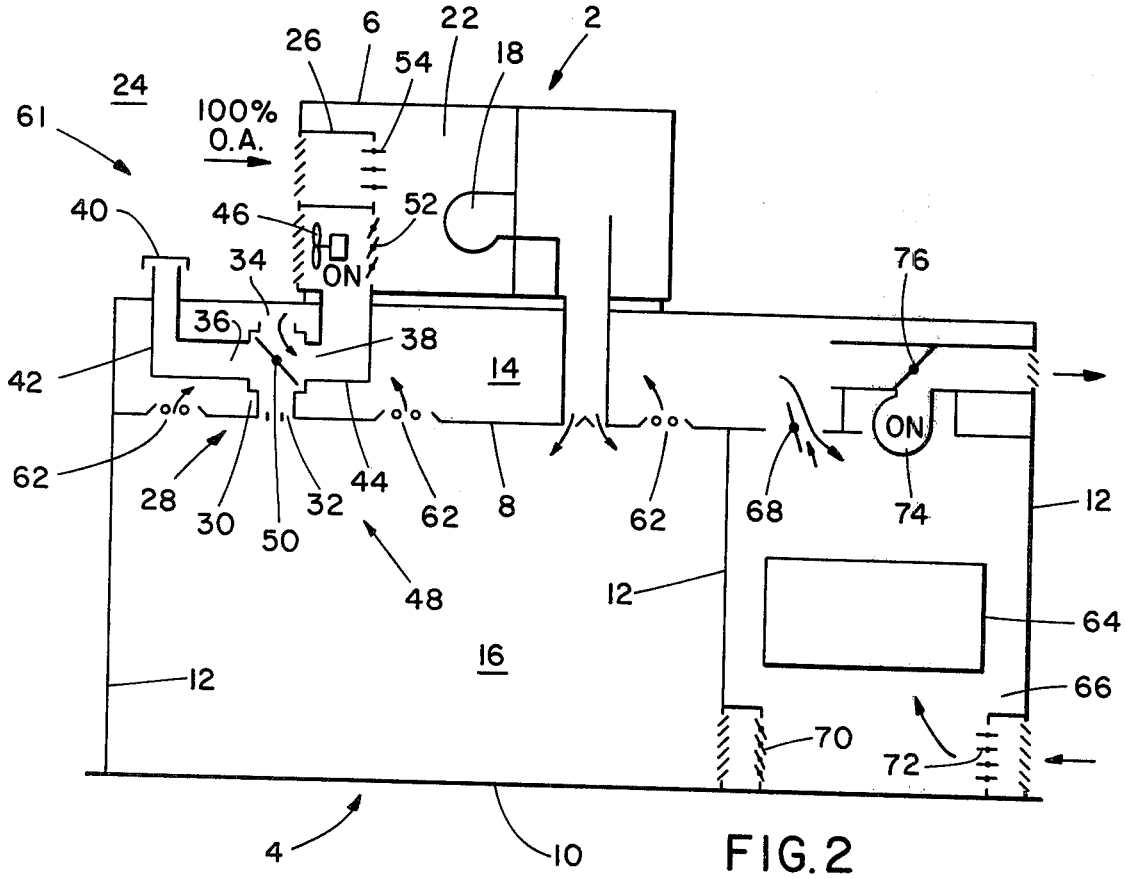
FIG. 2 shows the system of FIG. 1 in the non-mechanical cooling mode.
Figure 3:
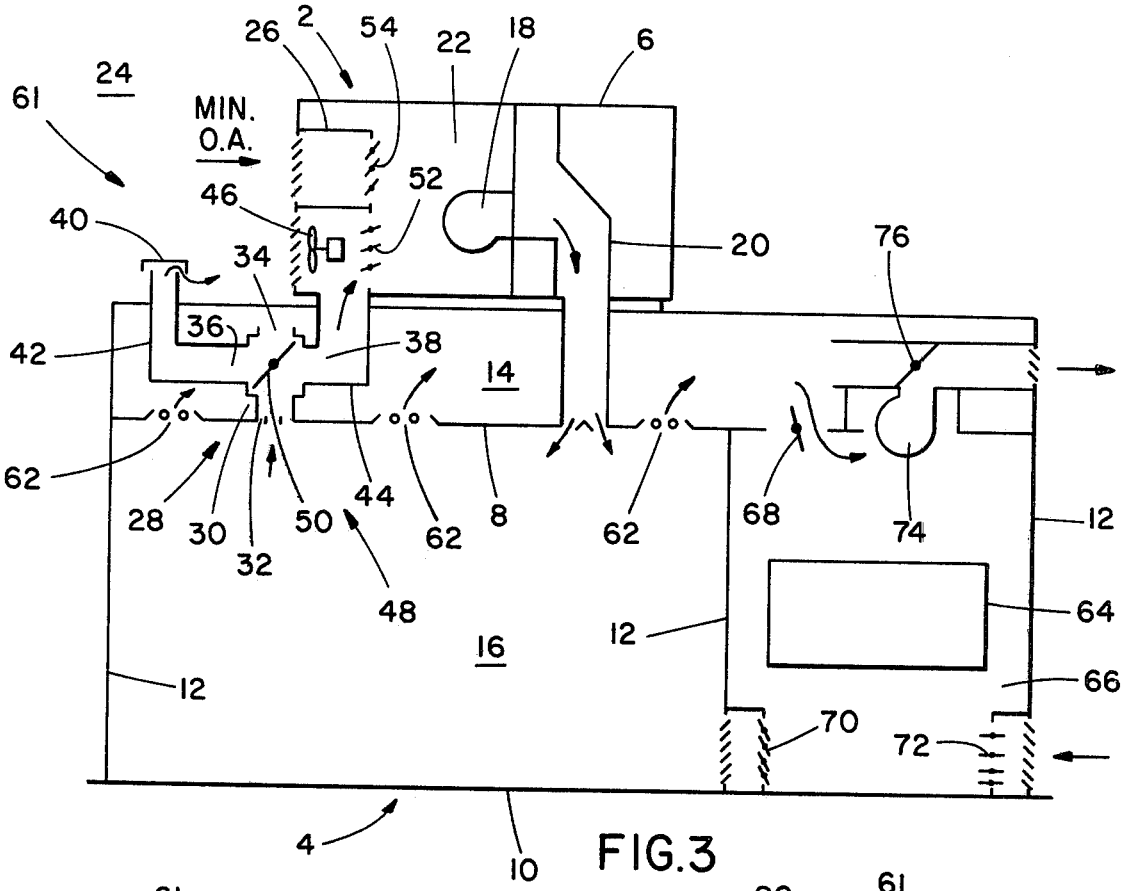
FIG. 3 shows the system of FIG. 2 in the mechanical cooling mode.

Referring to FIGS. 1–3, a preferred embodiment of the present invention is shown as an air processing system, generally designated 2. The system 2 conditions the air in an enclosure or building 4. As shown, the enclosure 4 includes a roof 6, ceiling 8, floor 10 and walls 12, which define a plenum region 14 and a single temperature zone or region 16. The plenum region 14 may, however, be the "sandwich space" between adjacent floors of a multi-story building (not shown).

The air processing unit 2 is shown in combination with a refrigeration system, shown schematically at 64. It is to be understood, however, that the air processing system 2 is independently and separately operable from the refrigeration system 3 in a manner described herein.

The air processing system 2 includes a conventional heating, ventilating and air conditioning unit 18 (hereinafter referred to HVAC unit 18). The HVAC unit 18, as shown, is mounted on the roof 6 and supplies the zone 16 with processed supply air through supply air means or duct 20. Registers or volume balancing dampers (not shown) are secured over the supply air outlets to the zone 16.

The HVAC unit 18 includes an air intake, generally designated 22. The air intake communicates with the outdoors, generally designated 24, through outdoor air means for duct 26. The air intake 22 communicates with the plenum region 14 and zone 16 through return air means, generally designated 28.

Return air means 28 includes air distribution means or box 30, having a first and second inlet 32, 34 and a first and second outlet 36, 38. The first and second inlets 32, 34 communicate directly with the zone 16 and plenum 14, respectively.

The first outlet 36 is connected to a ventilator 40 in the roof 6 through a first duct 42. The second outlet 38 is connected to and communicates with the air intake 22 of the HVAC unit 18 through a second duct, generally designated 44. Power exhaust means or fan 46 communicates with the second duct 44 to exhaust air therein to the outdoors 24.

Damper means, generally designated 48, controls and regulates the flow of air in outdoor air means 26 and return air means 28. Damper means 48 includes a first damper 50, second damper 52 and third damper 54. The first damper 50 selectively interconnects the first and second inlets 32, 34 of the air distribution box 30 with the first and second outlets 36, 38. The second damper 52 regulates the amount of air flow in the second duct 44 and, more particularly, the amount of return air supplied to the air intake 22 of the HVAC unit 18. The third damper 54 regulates and controls the amount of fresh outdoor air delivered to the HVAC unit 18 through the outdoor air duct 26.

The first damper 50 is a two-position damper. In the first position, the first inlet 32 of the air distribution box 30 is substantially open to the first duct 42 and substantially closed to the second duct 44, while the second inlet 34 is substantially closed to the first duct 42 and substantially open to the second duct 44. In the second position, the inlet-outlet interconnections are reversed.

Thus, the air entering the HVAC unit 18 is, at any time, substantially room air drawn from the zone 16, plenum air drawn from the plenum region 14, fresh outdoor air, a mixture of plenum and outdoor air or a mixture of room and outdoor air. The mixture volumes are determined by the second and third dampers 52, 54. Air flowing into and through the first duct 42 is exhausted to the outdoors 24 through ventilator 40.

As shown schematically in FIG. 1, the HVAC unit 18, power exhaust 46 and damper means 48 are responsive to temperature sensing means 56. For the sake of clarity, this schematic interconnection is only shown in FIG. 1. Temperature sensing means 56 is a conventional thermostat disposed in the zone 16. However, a differential temperature sensor, i.e., one sensing the temperature difference between the room and outside air, could be utilized. Temperature sensing means 56 controls the mode of operation of the HVAC unit 18 and power exhaust 46 and the setting of damper means 48.

The first damper 50 is actuated by a first conventional motor 58 controlled by temperature sensing means 56. The second and third dampers 52, 54 are actuated by a second motor 60. As shown schematically, the second and third dampers 52, 54 are interconnected for conjoint operation in response to the motor 60, although each damper 52, 54 may be separately actuated. Whether interconnected or not, the first and second dampers 52, 54 operate conversely, i.e., as one damper is opened towards the full open position, the other is closed.

The air processing system 2 also includes a series of air passing light fixtures 62 in the ceiling 8 of the enclosure 4. Air flows through the air passing light fixtures 62, in heat transfer relationship, from the zone 16 into the plenum region 14. With passage therethrough, the air absorbs the "heat of light" surrounding the fixtures 62 and is, in effect, "pre-heated" prior to receipt by the HVAC unit 18 or exhaustion to the outdoors 24.

The HVAC unit 18, outdoor air means 26, return air means 28, ventilator 40, power exhaust means 46, damper means 48, temperature sensing means 56, motors 58, 60, light fixtures 62, and included structure cooperatively define an air processing module 61. The term, air processing module 61, is defined here to facilitate the description of the multiple zone application.

In operation, temperature sensing means 56 determines and effects the necessary mode of operation of the HVAC unit 18 and power exhaust means 46 and appropriately actuates damper means 48 through motors 58, 60. In the single zone application, damper means 48 is operable in three states, depending upon the mode of operation of the HVAC unit 18.

In the heating mode, shown in FIG. 1, the HVAC unit 18 heats the air drawn into the air intake 22 and delivers the heated supply air to the zone 16. The power exhaust means 46 is inoperative.

The dampers 50, 52, 54 are positioned such that the first inlet 32 is open to and communicates with the ventilator 40 and the second inlet 34 and outdoor air duct 26 are adjustably open to the HVAC unit 18, as determined by dampers 52, 54. More particularly, the third damper 54 adjustably controls the amount of fresh outside air entering the air processing system 2 for purposes of ventilation. As used herein, "adjustably open," "adjustably controlled" and derivatives thereof indicate predetermined damper settings.

In the heating mode, the third damper 54 is actuated to a minimum outside air setting, permitting the HVAC unit 18 to draw 0–15 percent of its air intake from the outdoors (preferably 10 percent). The remaining air is, therefore, drawn from the plenum region 14 through air distribution box 30, second duct 44 and second damper 52. Volume balance is achieved and maintained by exhaustion of room air through the ventilator 40 and first duct 42.

The air flow pattern established in the heating mode of operation is a significant feature of the present invention. The plenum air, drawn to the HVAC unit 18, passes through the light fixtures 62 and absorbs, as previously discussed, the "heat of light" which surrounds these fixtures 62. Thus, the air is "pre-processed" or "pre-heated" prior to entering the HVAC unit 18. This preliminary heating decreases the amount of primary energy required in the HVAC unit 18, thereby reducing the operating cost of the air processing system 2.

The air processing system 2 is shown in the outside air or non-mechanical cooling mode in FIG. 2. In this mode, the cooling of the zone 16 is accomplished by up to 100 percent outside air and the mechanical cooling apparatus of the HVAC unit 18 is inoperative. As shown, the plenum region 14 and zone 16 communicate directly with the HVAC unit 18 and ventilator 40, respectively. The respective volume of plenum and outside air entering to the HVAC unit 18 is variably controlled by the second and third dampers 52, 54, in response to temperature sensing means 56. As previously discussed, the dampers 52, 54 operate conversely, such that the air received by the HVAC unit 18 ranges from substantially 100 percent plenum air to 100 percent fresh outside air. As used herein, "variably controlled," "variably open" and derivatives thereof indicate damper setting which vary with indoor and outdoor temperature conditions.

Power exhaust means 46 is operative, or intermittently operative, to exhaust a portion of the plenum air in the second duct 44 to the outdoors 24. For example, if a 60 percent outdoor air and 40 percent plenum air mixture is required to effectively cool the zone 16, then power exhaust means 46 exhausts substantially 60 percent of the plenum air to the outdoors 24. Total volume balance is achieved by the exhaustion of plenum air and room air through power exhaust means 46 and ventilator 40, respectively. One hundred percent outside air cooling is shown in FIG. 2, and thus, substantially all plenum air drawn through second duct 44 is exhausted by power exhaust means 46.

This air flow pattern is also a significant feature of the present invention. The exhausting of plenum air, drawn through the light fixtures 62, substantially reduces the "heat of light" in the zone 16. As 100 percent outside air cooling is approached, approximately 60 percent of the "heat of light" is exhausted. Thus, the air processing system 2 provides total non-mechanical cooling up to outside air temperatures of 62° F. or 63° F., as compared to the 56° F. limit experienced with the presently known air processing systems. A substantial savings in the operating cost of the air processing system 2 is, therefore, realized.

When the zone 16 requires mechanical cooling, shown in FIG. 3, air from the zone 16 enters the air intake 22 of the HVAC unit 18 through the second duct 44, adjustably controlled by the second damper 52. The third damper 54 is actuated to the minimum outside air setting and adjustably controls the amount of outdoor air for ventilation, e.g., 10 percent. Power exhaust means 46 is inoperative. As such, the air processing system 2 is substantially a closed system in this mode.

Plenum air, equal to the amount of outside air taken in through outdoor air duct 26, is exhausted through ventilator 40. This exhausted plenum air substantially reduces the "heat of light" within the zone 16. As such, the amount of mechanical cooling required by the HVAC unit 18 is substantially reduced, thereby further reducing the operating cost of the air processing system 2.

In addition, the necessary air conditioning capacity of the HVAC unit 18 is reduced. That is, less cooling is required per square foot than with the presently known air processing systems. Thus, a smaller and less expensive HVAC unit 18 may be utilized.

Another advantage of the air processing system 2 results from the continuous ventilation of the light fixtures 62. This ventilation increases the output of the light fixtures 10 to 20 percent, as compared with unvented fixtures.

As previously indicated, the air processing system 2 is adaptable for use in conjunction and combination with a refrigeration system 64, as found, for example, in a supermarket. A significant feature of this combination is the recapture by the air processing system 2 of heat rejected by the refrigeration system.

Referring again to FIGS. 1–3, the refrigeration system 64 is located within a condenser room 66. As shown, air is drawn into the condenser room 66 from the plenum region 14, zone 16 and outdoors 24 through a plenum damper 68 in the ceiling 8, a room damper 70 in an interior wall 12 and an outdoor damper 72 in an exterior wall 12, respectively. Air is exhausted from the condenser room 66 by a blower 74. The exhausted air is directed to the plenum region 14 or the outdoors 24 by a control damper 76.

In the heating mode, shown in FIG. 1, the plenum damper 68 is closed, room damper 70 is open, outdoor damper 72 is closed, blower 74 is operative and control damper 76 is in a plenum air position, i.e., directing the exhausted air from the condenser room 66 into the plenum region 14. As such, a portion of the plenum air, drawn to the HVAC unit 18, has passed through the relatively warm environment of the refrigeration system 64, absorbing heat. This heat is added to the heat absorbed from the light fixtures 62, thereby further reducing the amount of necessary mechanical heating.

In the outside air, non-mechanical cooling mode, shown in FIG. 2, the plenum air damper 68 is open, room damper 70 is closed, outdoor damper 72 is open, blower 74 is operative and control damper is in an exhaust position, i.e., the exhausted air is directed to the outdoors 24. Plenum air and, consequently, the "heat of light" are, therefore, exhausted to the outdoors 24 by both power exhaust means 46 and blower 74. The outdoor damper 72 is open to facilitate rejection of refrigeration condenser heat from the condenser room 66.

This operation does not change as the air processing system 2 switches to mechanical cooling, as shown in FIG. 3. As such, plenum air and "heat of light" are mechanically exhausted to the outdoors 24 through the condenser room 66 and blower 74, in contrast to the gravity relief of plenum air alone in the independent and separate operation of the air processing system 2.

Referring now to FIGS. 4-7, a second preferred embodiment of the present invention is shown as a multizone air processing system 80. The air processing system 80 includes a pair of air processing modules 61 for cooperatively conditioning the air in an enclosure 82, having a plenum 84 and separate and distinct temperature zones 86, 88. As shown, the plenum 84 is continuous and common to both air processing modules 61.

Figure 4:
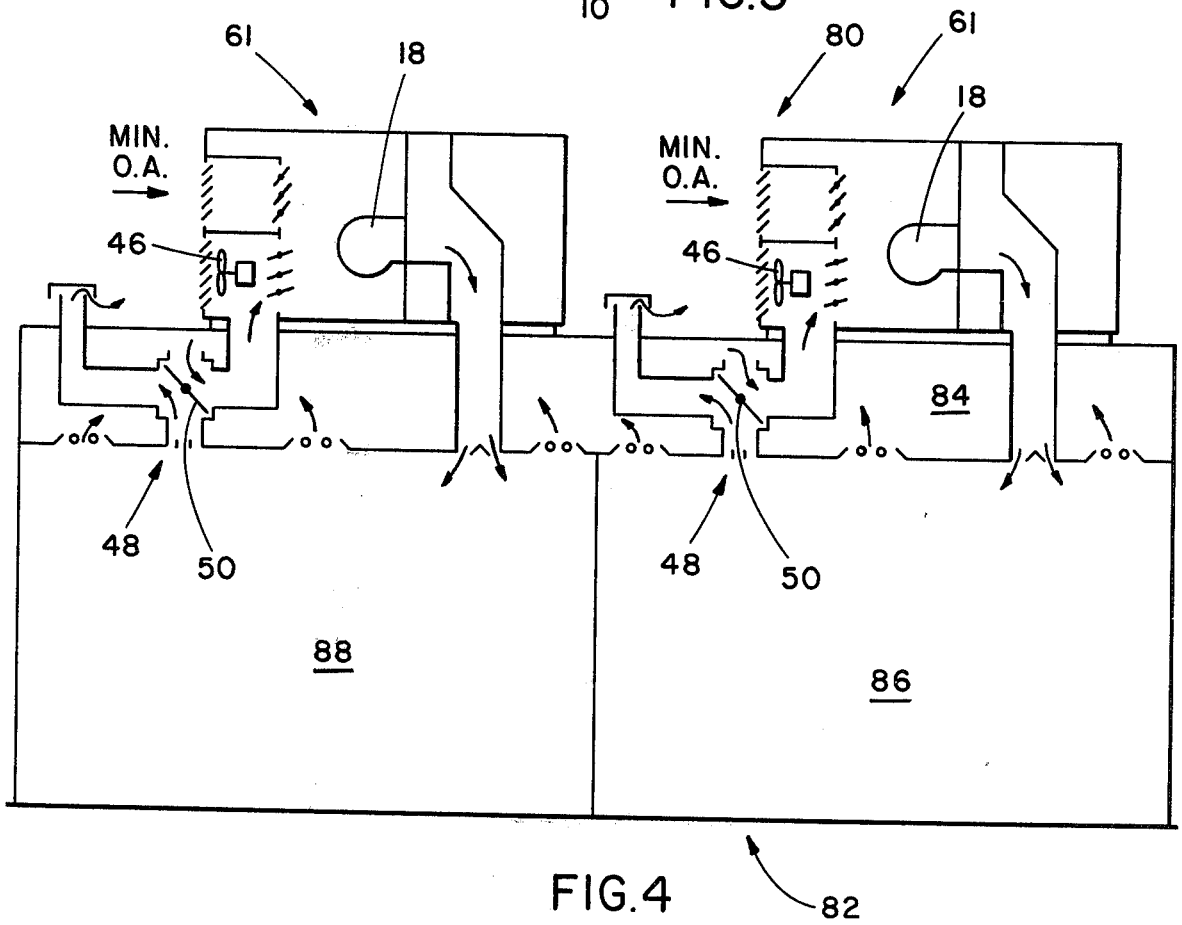
FIG. 4 shows a preferred embodiment of the present invention in a multizone application, operating in the heating mode.
Figure 6:
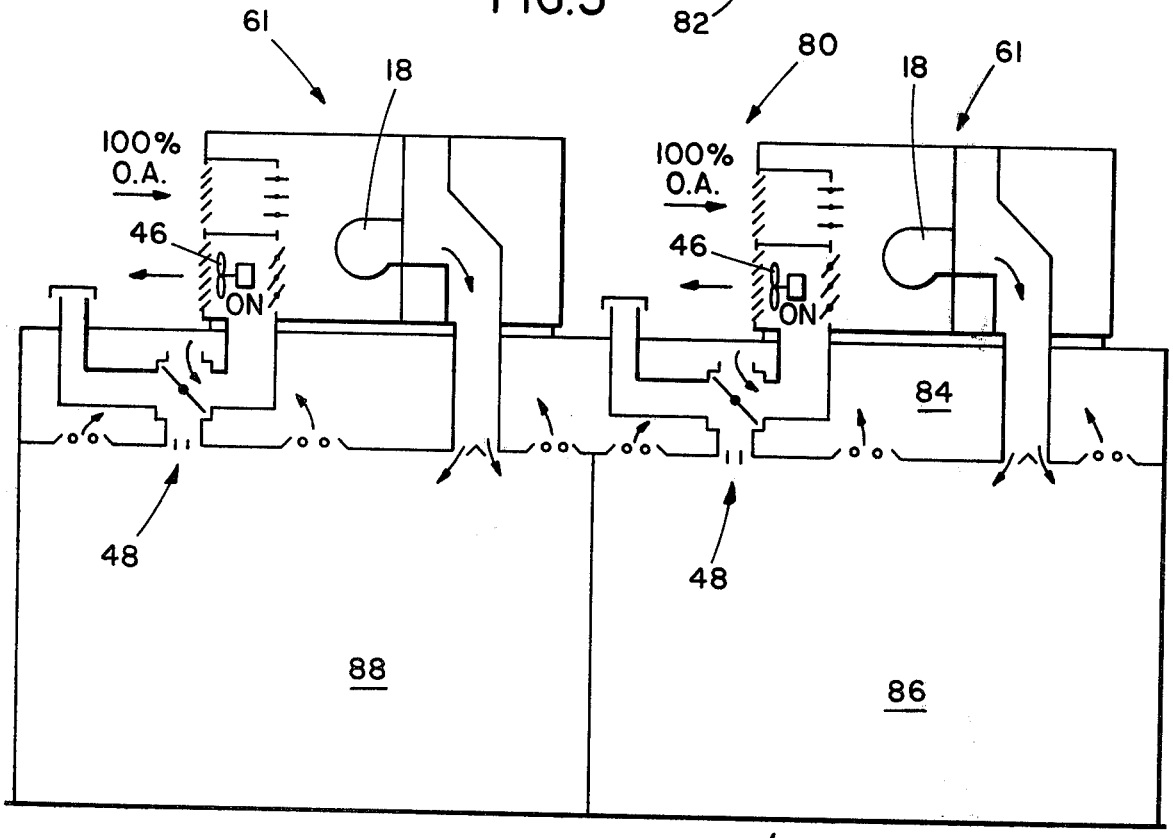
FIG. 6 shows the system of FIG. 4, operating in the 100 percent outside air non-mechanical cooling mode.
Figure 7:
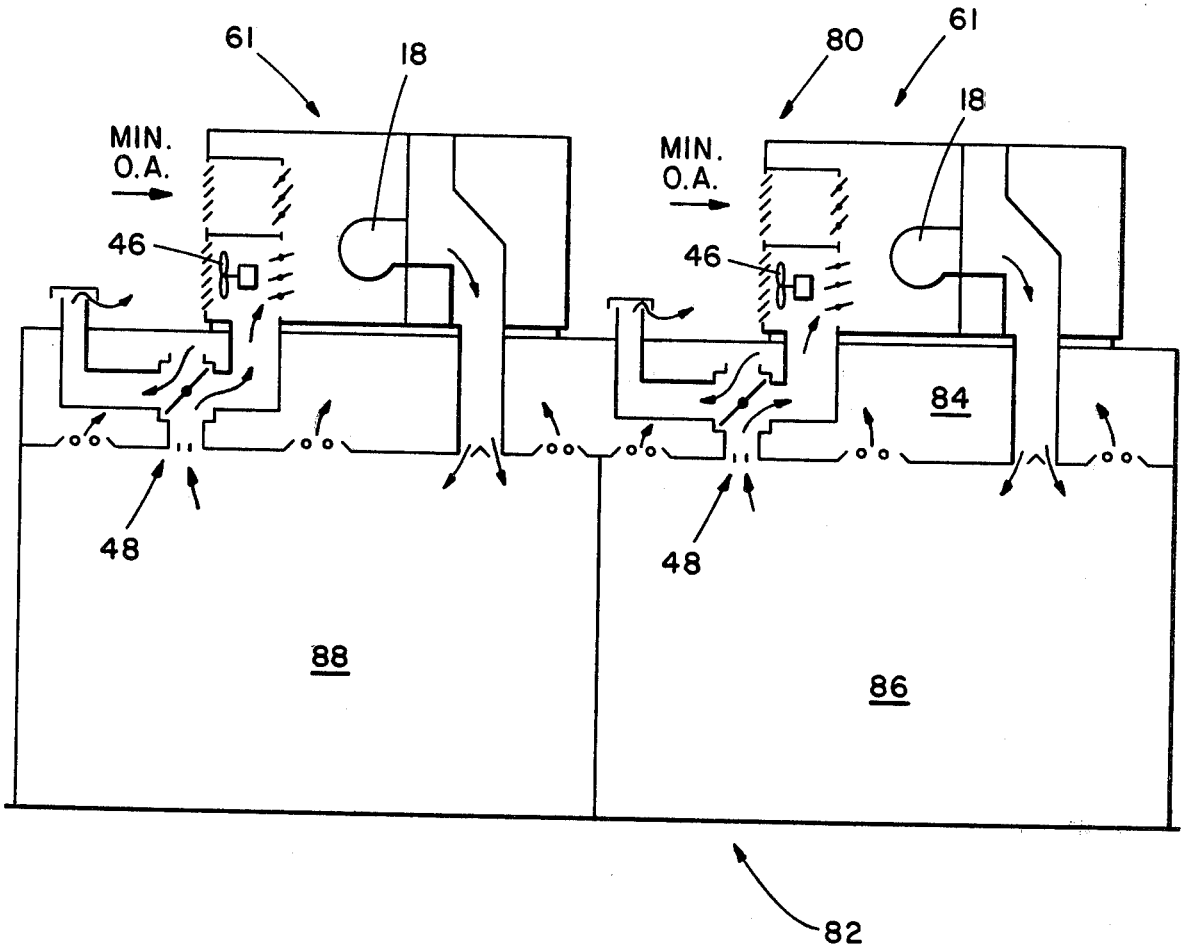
FIG. 7 shows the system of FIG. 4, operating in the mechanical cooling mode.

As shown specifically in FIGS. 4, 6 and 7, each air processing module 61 functions substantially as the single zone air processing system, previously described. That is, the air processing module 61 operates, under appropriate conditions, in each of the three modes of the air processing system 2, i.e., heating, outside air or non-mechanical cooling and mechanical cooling, shown in FIGS. 4, 6 and 7, respectively.

Figure 5:
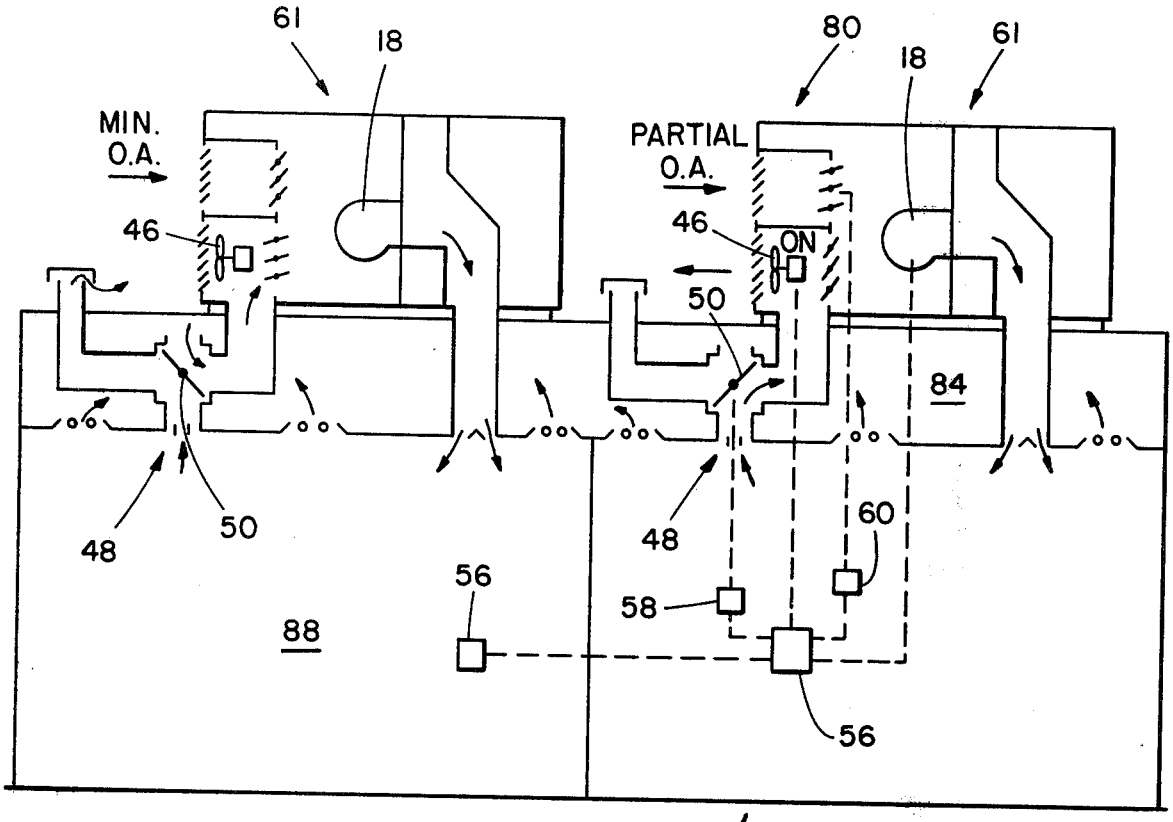
FIG. 5 shows the system of FIG. 4, operating in the heating and mechanical cooling modes.

With reference to FIG. 5, the air processing module 61 in the multizone system 80 and, more particularly, damper means 48 of each module 61 are also operable in a fourth mode or state. This fourth state of operation only occurs when a zone, e.g., zone 86, is in the outside air or non-mechanical cooling state and another zone, e.g., zone 88, requires heating. As previously discussed, plenum air and "heat of light" are normally exhausted by the power exhaust 46 in the non-mechanical cooling mode. To substantially avoid waste and to "salvage" this "heat of light" for use in the zone 88, the first damper 50 associated with zone 86, under the aforesaid conditions, changes over from the normal non-mechanical cooling position. As such, the zone 86 communicates directly with the second duct 44, power exhaust means 46 and HVAC unit 18. Air passing from the zone 86 through the light fixtures 62 and into the plenum 84 is no longer exhausted by power exhaust means 46 and is available to the HVAC unit 18 associated with zone 88.

In the multizone system 80, damper means 48 associataed with one zone is, therefore, responsive to the temperature sensing means 56 associated with the other zones, as shown schematically in FIG. 5 with respect to zones 86, 88. Through control means (not shown), the disassociated temperature sensing means 56 causes the change over of damper 50, whenever the appropriate conditions are met.

The multizone air processing system 80 has been theoretically compared with a presently known system for a 100,000 square foot store in both Los Angeles, California and Dallas, Texas. Predicted energy savings are substantial: 31.9 and 68.4 percent savings in daytime and night time operation, respectively, in Los Angeles, and 20.6 and 32.7 percent savings for daytime and night time operation, respectively, in Dallas.

An additional capability of the air processing system 80 is the clearing or removal of smoke from a selected zone. Suitable detectors (not shown) responsive to the presence of smoke (or a predetermined excessive temperature) in the enclosure 82 are provided and override the temperature sensing means 56. The detectors are interconnected with power exhaust means 46 and damper means 48. When smoke is detected in a zone area, power exhaust means 46 is fully activated to withdraw maximum air from the affected zone and outdoor air means 26 is fully opened to permit maximum flow of outside air to the zone, thereby effecting maximum air turnover. There is a flow of outside air into adjacent zones with less withdrawal to avoid migration of smoke from the affected zone into the adjacent zones.

In multizone applications, it is also often desirable to move "heat of light" from the core zones of the enclosure being treated to the perimeter thereof. The HVAC unit or units 18 of the air processing system 80 in the core or central zones of the enclosure 82 may, therefore, be adapted to receive return air only directly from the zone with the "heat of light" from the core zones being carried through the plenum 84 to the perimeter. There are less heat losses in the core region, and thus, core heat is transferred to the perimeter where higher heat losses are experienced. This, too, results in a significant savings in energy.

There has been disclosed herein particular embodiments of the present invention. It is to be understood, however, that changes and modifications can be made without departing from the true scope and spirit of the present invention, as defined in the following claims.

What is claimed is:

1. An air processing system for an enclosure, having a plenum, comprising, in combination:

temperature sensing means for sensing the air temperature within said enclosure;

air processing means for supplying a stream of processed supply air to said enclosure, said air processing means being responsive to said temperature sensing means;

air passing light fixtures between said enclosure and said plenum, air within said enclosure passing in heat transfer relationship with said light fixtures into said plenum;

ventilation means in communication with the outdoors;

outdoor air means for directing a stream of fresh outdoor air to said air processing means, said outdoor air means having a minimum outdoor air setting;

return air means for directing a stream of return air to said air processing means, said return air means including air distribution means having a first and second inlet and a first and second outlet, said first and second inlets communicating with said enclosure and said plenum, respectively, said first outlet communicating with said ventilation means through a first duct, said second outlet communicating with said air processing means through a second duct;

power exhaust means in communication with said second duct for exhausting air therein to the outdoors, said power exhaust means being responsive to said temperature sensing means; and damper means for controlling the flow of air through said air return means, said damper means being responsive to said temperature sensing means.

2. An air processing system as claimed in claim 1 wherein:

said damper means is operable in a first state to interconnect said first and second inlets with said first and second outlets, respectively, to adjustably open said second duct to said air processing means and to adjustably open said outdoor air means to said minimum outdoor air setting, said power exhaust means being inoperative, whereby plenum air preheated by said air passing light fixtures is returned to said air processing means and room air within said enclosure is exhausted through said ventilation means to substantially maintain volume balance;

said damper means is operable in a second state to interconnect said first and second inlets with said first and second outlets, respectively, and to variably open said second duct and said outdoor air means to said air processing means, said power exhaust means being operative, whereby said enclosure is cooled by up to 100 percent outside air; and said damper means is operable in a third state to interconnect said first and second inlets with said second and first outlets, respectively, to adjustably open said second duct to said air processing means and to adjustably open said outdoor air means to said minimum outside air setting, said power exhaust means being inoperative, whereby air from said enclosure is returned to said air processing means and plenum air pre-heated by said air passing light fixtures is exhausted through said ventilation means to substantially maintain volume balance.

3. An air processing system as claimed in claim 1 wherein said minimum outside air setting permits 0–15 percent outside air.

4. An air processing system as claimed in claim 1 wherein said damper means includes first, second and third dampers.

5. An air processing system as claimed in claim 4 wherein said first damper is secured within said air distribution means to selectively interconnect said first and second inlets with said first and second outlets.

6. An air processing system as claimed in claim 4 wherein said second damper is secured within said second duct to substantially regulate the flow of air therethrough.

7. An air processing system as claimed in claim 4 wherein said third damper is secured within said outdoor air means to substantially regulate the flow of outside air therethrough.

8. An air processing system as claimed in claim 1 further comprising motor means responsive to said temperature sensing means for actuating said damper means.

9. In a system for processing the air in an enclosure, having a plenum and at least one temperature zone, an air processing module for each zone comprising, in combination:

temperature sensing means for sensing the air temperature within said enclosure;

air processing means for supplying a stream of processed supply air to said enclosure, said air processing means being responsive to said temperature sensing means;

air passing light fixtures between said enclosure and said plenum, air within said enclosure passing in heat transfer relationship with said light fixtures into said plenum;

ventilation means in communication with the outdoors;

outdoor air means for directing a stream of fresh outdoor air to said air processing means, said outdoor air means having a minimum outdoor air setting;

return air means for directing a stream of return air to said air processing means, said return air means including air distribution means having a first and second inlet and a first and second outlet, said first and second inlets communicating with said enclosure and said plenum, respectively, said first outlet communicating with said ventilation means through a first duct, said second outlet communicating with said air processing means through a second duct;

power exhaust means in communication with said second duct for exhausting air therein to the outdoors, said power exhaust means being responsive to said temperature sensing means; and damper means for controlling the flow of air through said air return means, said damper means being responsive to said temperature sensing means.

10. An air processing module as claimed in claim 9 wherein:

said damper means is operable in a first state to interconnect said first and second inlets with said first and second outlets, respectively, to adjustably open said second duct to said air processing means and to adjustably open said outdoor air means to said minimum outdoor air setting, said power exhaust means being inoperative, whereby plenum air preheated by said air passing light fixtures is returned to said air processing means and room air within said enclosure is exhausted through said ventilation means to substantially maintain volume balance;

said damper means is operable in a second state to interconnect said first and second inlets with said first and second outlets, respectively, and to variably open said second duct and said outdoor air means to said air processing means, said power exhaust means being operative, whereby said enclosure is cooled by up to 100 percent outside air; and said damper means is operable in a third state to interconnect said first and second inlets with said second and first outlets, respectively, to adjustably open said second duct to said air processing means and to adjustably open said outdoor air means to said minimum outside air setting, said power exhaust means being inoperative, whereby air from said enclosure is returned to said air processing means and plenum air pre-heated by said air passing light fixtures is exhausted through said ventilation means to substantially maintain volume balance.

11. An air processing module as claimed in claim 10 wherein said enclosure has two temperature zones.

12. An air processing module as claimed in claim 11 wherein said damper means for one of said zones is operable in a fourth state, whenever said damper means for said one of said zones is initially in said second state and said damper means for the other of said zones is in said first state, to interconnect said first and second inlets with said second and first outlets, respectively, and to variably open said second duct and said outdoor air means to said air processing means, said power exhaust means for said one of said zones being operative, whereby air drawn from said one of said zones into said plenum and pre-heated by said air passing light fixtures is available to said air processing means for said other of said zones.

13. An air processing system as claimed in claim 9 wherein said damper means includes first, second and third dampers.

14. An air processing system as claimed in claim 9 wherein said first damper is secured within said air distribution means to selectively interconnect said first and second inlets with said first and second outlets.

15. An air processing system as claimed in claim 9 wherein said second damper is secured within said second duct to substantially regulate the flow of air therethrough.

16. An air processing system as claimed in claim 9 wherein said third damper is secured within said outdoor air means to substantially regulate the flow of outside air therethrough.

* * * * *